United States Patent [19]

Okamoto et al.

[11] Patent Number: 4,666,385

[45] Date of Patent: May 19, 1987

[54] ROOTS TYPE BLOWER

[75] Inventors: Toshiaki Okamoto, Okazaki; Masahiro Fukuta, Nagoya, both of Japan

[73] Assignee: Aisin Seiki Kabushiki Kaisha, Aichi, Japan

[21] Appl. No.: 698,821

[22] Filed: Feb. 6, 1985

[30] Foreign Application Priority Data

Mar. 13, 1984 [JP] Japan ..... 59-036224[U]

[51] Int. Cl.[4] ..... F04C 18/24

[52] U.S. Cl. ..... 418/201; 418/206

[58] Field of Search ..... 418/201-206

[56] References Cited

U.S. PATENT DOCUMENTS

| | | | |
|---|---|---|---|
| 4,210,410 | 6/1980 | Ohtani | 418/201 |
| 4,224,015 | 9/1980 | Nagata | 418/201 |
| 4,329,130 | 5/1982 | Nagata | 418/201 |

*Primary Examiner*—Carlton R. Croyle
*Assistant Examiner*—Jane E. Obee
*Attorney, Agent, or Firm*—Burns, Doane, Swecker & Mathis

[57] ABSTRACT

A Roots type blower is disclosed having rotors with twisted-shape and projections on the pitch circle. The blower is compact in the axial direction, because the projections work as gearing between the rotors. Therefor, it is not necessary to provide additional gears for driving the rotors. Each of the rotors has a twisted-shape with a relationship of $n \times \theta \geqq 2\pi$, where n is the number of leaves and $\theta$ is the lead angle.

6 Claims, 4 Drawing Figures

Fig. 3
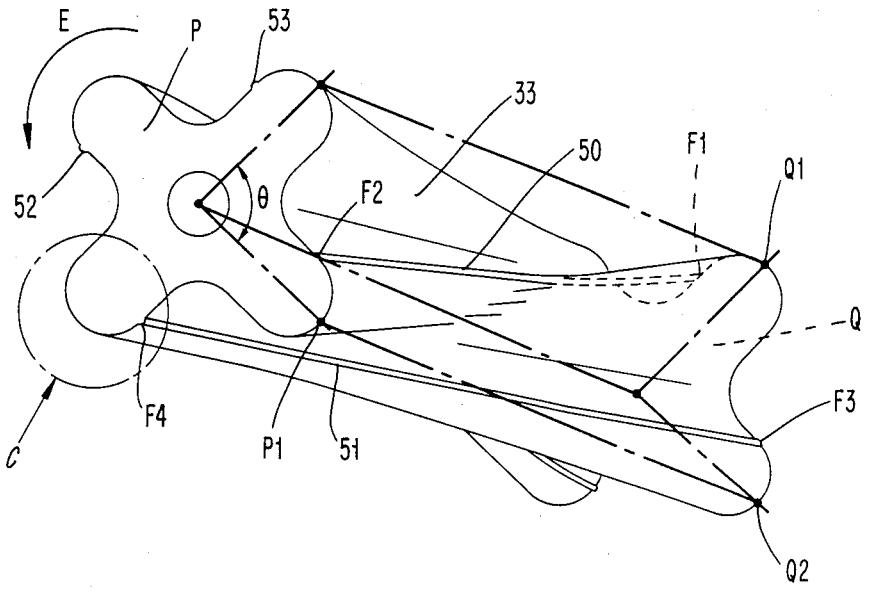
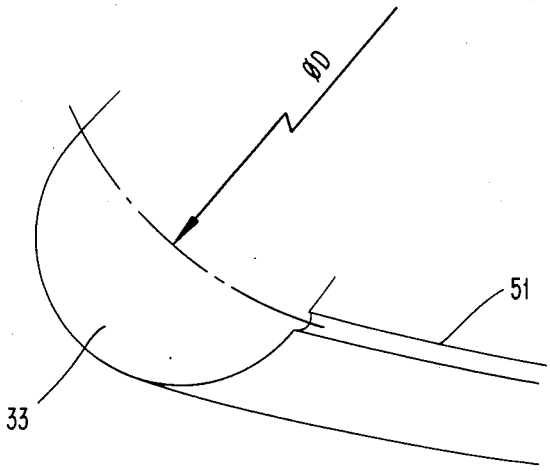
Fig. 4

ROOTS TYPE BLOWER

FIELD OF THE PRESENT INVENTION

The present invention relates to an improvement in Roots type blowers, more particularly to an improvement in the rotors of a Roots type blower having twisted-shape thereof.

Roots type blowers have generally been used as a compressor or a blower. The present invention is applicable to those as mentioned above, and particularly applicable to a supercharger having the same structure specifically used for internal combustion engines, e.g., diesel engines.

BACKGROUND OF THE PRESENT INVENTION

The Roots type blower as shown in FIG. 1 is a two-shaft type blower. A housing 11 has an inner space 12 which is peculiar to the Roots type blower and an intake port 13 and a discharge port 14 which are communicated with the inner space 12. Two shafts 15 and 16 are rotatably disposed in the inner space 12 of the housing 11 by supports such as bearings 17, 18, 19 and 20 so that a given spacing, i.e., a gap, is provided between the shafts 15 and 16. The lower shaft 15 serves as a driving shaft.

The shafts 15 and 16 are rotated in opposite directions by synchronizing gears 21 and 22 which are disposed outside the housing 11. Rotors 23 and 24 are secured to the shafts 15 and 16, respectively, so that the rotors rotate in a predetermined phase with respect to each other. The rotors 23 and 24 are rotated in a spaced relationship with each other and with the inner wall of the housing 11 so that they do not interfere with each other.

When the rotors 23 and 24 are rotated, the blower intakes air from the intake port 13 and imparts kinematic energy to the air in the rotational directions of the rotors 23 and 24 within the inner space 12 of the housing 11. The blower then discharges the compressed air from the discharge port 14. Such a conventional Roots type blower has a disadvantage, among others, that is necessary to provide axial space in which to dispose the gears 21 and 22.

SUMMARY OF THE PRESENT INVENTION

It is an object of the present invention to provide Roots type blower which is free of the aforementioned disadvantage and others.

It is another object of the present invention to provide a Roots type blower which does not need to supply oil to gears.

These objects and others of the present invention are accomplished by making the rotor with a twisted-shape and having a relationship of $n \times \theta \geqq 2\pi$, where n is the number of leaves and $\theta$ is the lead angle, and by providing projections on the pitch circle on the outer faces of the rotor. The projections engage one another to synchronously drive the rotors thereby eliminating the need for additional gearing in an axial direction.

BRIEF DESCRIPTION OF THE DRAWINGS

A preferred embodiment of the present invention will be described in greater detail with reference to the accompanying drawings, wherein like members bear like reference numerals, and wherein:

FIG. 3 is a perspective view of the rotor according to the blower of the present invention; and FIG. 4 is a magnified view of section C in FIG. 3.

DETAILED DESCRIPTION OF THE PREFERRED EMBODIMENTS

Figure 1:
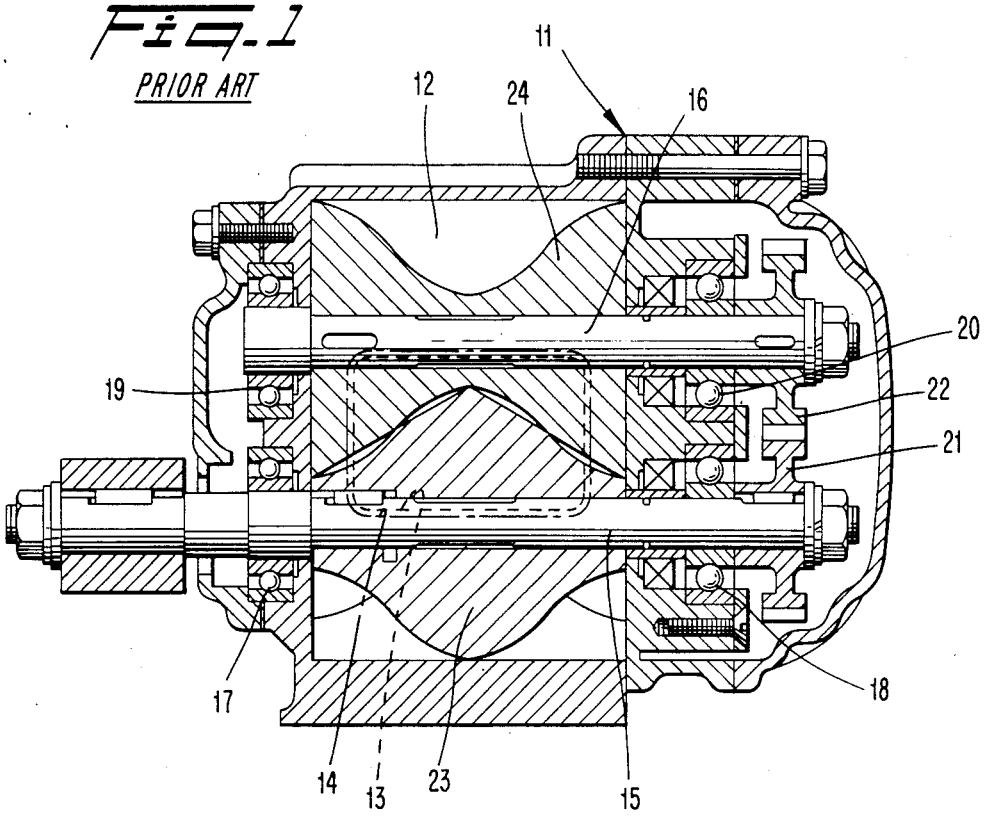
Fig. 1 PRIOR ART
FIG. 1 is a cross-sectional view of a conventional Roots type blower.
Figure 2:
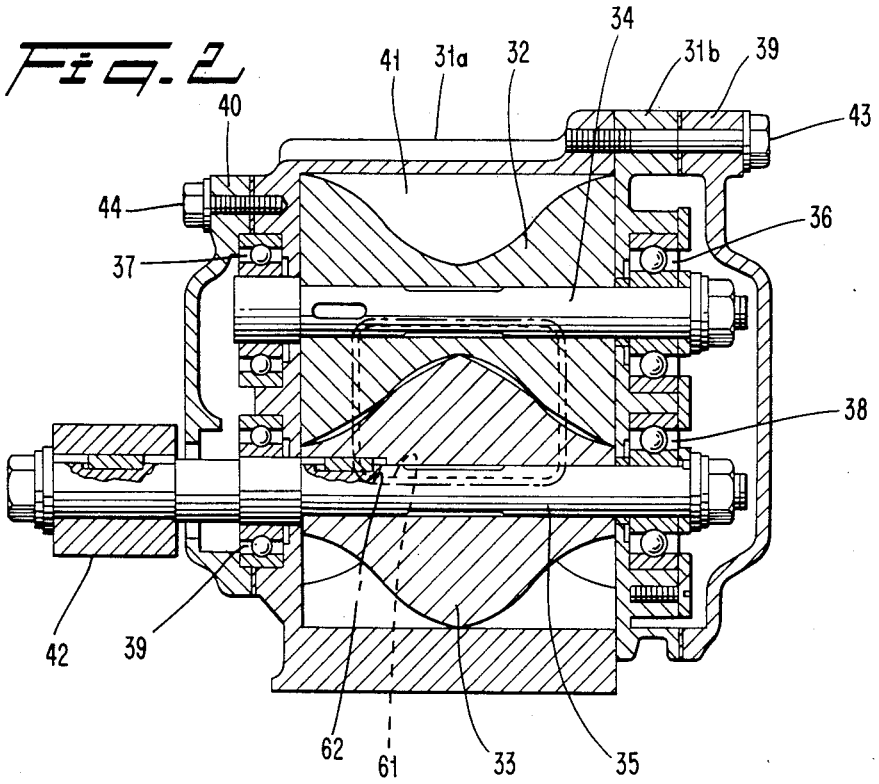
FIG. 2 is a cross-sectional view of a Roots type blower according to the present invention.

With reference to FIG. 2, a housing 31*a* forms an inner space 41 with a housing cap 31*b* and possesses an intake port 61 and a discharge port 62 in an opposite position of the housing wall. A driving shaft 35 with a rotor 33 secured thereto is supported with bearings 38 and 39 in the housing 31*a* and the housing cap 31*b*, respectively. A pulley 42 connected to a drive source (e.g., an engine) is secured on the driving shaft 35.

A driven shaft 34 with a rotor 32 secured thereto is also supported with bearings 36 and 37 in the housing 31*a* and the housing cap 31*b*, respectively. Covers 39 and 40 are secured to the housing 31*a* and the housing cap 31*b* with bolts 43 and 44.

The driving rotor 33 has four leaves and a twisted-shape as illustrated in FIG. 3. On one leaf, a top P1 of one side P is twisted at an angle $\theta$ against a top Q1 of another side Q. $\theta$ is a lead angle, and is 90° in this case. The driving rotor 33 has projections 50, 51, 52 and 53 on the leaves. The projections 50, 51, 52 and 53 are on a pitch circle $\phi$D (FIG. 4) and in a rotational direction of the E side of the rotor 33.

A driven rotor 32 also has four leaves and a twisted-shape. A lead angle of the driven rotor 32 is the same as the lead angle of the driving rotor 33. The driven rotor 32 also has projections on the leaves, on a pitch circle and in a rotational direction side. One of the projections of the driving rotor 33 always engages with one of the projections of the driven rotor 32.

A point F1 of the driving rotor 33 engages with a point of one of the projections of the driven rotor 32. During rotation, the engaged point F1 moves to a point F2 on the projection 50. At this time, engagement of a point F3 on the next projection 51 with the driven rotor 32 also occurs. During further rotation, the engaged point F3 moves to F4 on the projection 51.

As described previously in the illustrated embodiment, the number of leaves n is 4, and the lead angle $\theta$ is 90°. However, if a different number of leaves n or a different lead angle $\theta$ is utilized, the values are determined under the algebraic formula:

$$n \times \theta \geqq 2\pi$$

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the scope of the present invention. Accordingly, it is expressly intended that all such variations and changes which fall within the spirit and scope of the present invention as defined in the claims be embraced thereby.

What is claimed is:

1. A Roots type blower comprising:

a housing having an intake port and a discharge port;

first and second rotors, each rotor having a plurality of leaves;

means for rotatably supporting said first and second rotors in an inner space at least partially defined by said housing;

each of the rotors having a twisted-shape with a relationship of:

$$n \times \theta \geqq 2\pi$$

where, n is the number of leaves of the rotor, and $\theta$ is the lead angle;

means for rotationally driving said first rotor; and means for rotationally driving said second rotor from said first rotor including a longitudinally extending projection on each leaf of each rotor, each of said projections protruding from an outer face of said leaves where a pitch circle of the rotor intersects said outer face, said second rotor being positioned adjacent said first rotor such that the rotors synchronously rotate with projections of said first rotor drivingly engaging projections of said second rotor.

2. The Roots type blower of claim 1, wherein for each leaf, regions of said outer face contiguous of said projection on said leaf form a continuous curve with each other.

3. The Roots type blower of claim 1, wherein n equals 4 and $\theta$ equals 90°.

4. The Roots type blower of claim 3, wherein for each leaf, regions of said outer face contiguous of said projection on said leaf form a continuous curve with each other.

5. The Roots type blower of claim 1, wherein each leaf of said first rotor drivingly engages a leaf of said second rotor at a point of contact, which point of contact moves along said projections of said engaging leaves from one end of said projections to another.

6. The Roots type blower type blower of claim 5, wherein said rotors are positioned relative to each other so that engagement of an engaging pair of leaves initiates simultaneously with disengagement of another pair of leaves.

* * * * *